US010343429B2

(12) United States Patent
Kodama et al.

(10) Patent No.: US 10,343,429 B2
(45) Date of Patent: Jul. 9, 2019

(54) RECORDING SYSTEM AND RECORDING APPARATUS

(71) Applicant: SEIKO EPSON CORPORATION, Tokyo (JP)

(72) Inventors: Hidetoshi Kodama, Nagano (JP); Tomohiro Yasufuku, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/946,172

(22) Filed: Apr. 5, 2018

(65) Prior Publication Data

US 2018/0311981 A1 Nov. 1, 2018

(30) Foreign Application Priority Data

Apr. 28, 2017 (JP) ..... 2017-089835

(51) Int. Cl.
*B41J 29/38* (2006.01)
*B41J 13/00* (2006.01)
*B41J 3/60* (2006.01)

(52) U.S. Cl.
CPC ..... *B41J 13/0045* (2013.01); *B41J 3/60* (2013.01); *B41J 13/0009* (2013.01); *B41J 13/009* (2013.01)

(58) Field of Classification Search
None
See application file for complete search history.

(56) References Cited

U.S. PATENT DOCUMENTS

2005/0190251 A1* 9/2005 Katsuyama ..... B41J 3/60 347/104
2012/0288290 A1* 11/2012 Hano ..... G03G 15/238 399/49
2013/0249992 A1* 9/2013 Katagami ..... B41J 13/0009 347/16
2013/0278654 A1* 10/2013 Ito ..... B41J 2/17566 347/6
2014/0368848 A1* 12/2014 Takata ..... B65H 29/60 358/1.12
2015/0002571 A1* 1/2015 Kono ..... B41J 13/0036 347/16
2015/0009258 A1* 1/2015 Moriyama ..... B41J 13/0009 347/16
2015/0151944 A1 6/2015 Shirasaki et al.
2015/0274477 A1* 10/2015 Kodama ..... B65H 5/36 271/3.19
2016/0280495 A1 9/2016 Kodama et al.

FOREIGN PATENT DOCUMENTS

JP 2015-107840 A 6/2015
JP 2016-185867 A 10/2016

* cited by examiner

*Primary Examiner* — Matthew Luu
*Assistant Examiner* — Tracey M McMillion

(57) ABSTRACT

A medium after recording is more effectively dried in a recording apparatus and improvement of throughput is achieved.

14 Claims, 8 Drawing Sheets

RECORDING SYSTEM AND RECORDING APPARATUS

BACKGROUND

1. Technical Field

The present invention relates to a recording apparatus and a recording system having the recording apparatus that performs recording on a medium such as a transported paper sheet.

2. Related Art

In the related art, a recording system is known that has a recording apparatus (image forming apparatus) that records an image by ejecting liquid on a paper sheet that is an example of a medium, and a post-processing device that carries out post-processing such as punching processing or stapling processing on the paper sheet on which the image is recorded.

The recording system described in JP-A-2016-185867 has a printer 100 as the recording apparatus that records an image on a paper sheet, a post-processing device 300 that carries out post-processing on the paper sheet on which the image is recorded, and a transport device 200 (hereinafter, referred to as a "relay unit") that is configured with a transport path, the transport device 200 being position between the printer 100 and the post-processing device 300. The printer 100 is configured to be able to record on both surfaces of a first surface and a second surface that is on an opposite side of the first surface.

In addition, in JP-A-2016-185867, the printer 100 is provided with a discharge port 155 for directly ejecting the paper sheet after recording from the printer 100 without sending the paper sheet to the post-processing device 300 via the transport device 200.

Note that, in a case where recording is continuously performed on a plurality of paper sheets, on a preceding medium and a subsequent medium, the greater the moisture content of the liquid (for example, ink) that remains on a recording surface, the larger friction resistance becomes on the respective media. Therefore, when the subsequent medium is stacked on the preceding medium, the preceding medium may move with the momentum of the discharge of the subsequent medium when the subsequent medium comes into contact with the preceding medium. Thereby, there is a concern that a stacked state of the preceding medium is disturbed.

In order to suppress the disturbance of the stacked state of the preceding medium by the discharged subsequent medium, it is effective to dry the medium before discharge from the discharge port to reduce friction resistance on the medium.

Therefore, in the printer 100 in JP-A-2016-185867, for example, when both-surface recording is performed, there may be a configuration such that a wait time (drying time) until the liquid on the recording surface is dried is set, and the paper sheet after recording is discharged from the discharge port after the wait time has elapsed and the recording surface is sufficiently dried.

However, simply carrying out to sufficiently dry the medium after recording causes a decrease in throughput, and therefore further efforts are required in order to dry the medium while mitigating the decrease in throughput.

SUMMARY

According to an aspect of the invention, there is provided a recording apparatus that includes: a recording section that performs recording by ejecting liquid on a medium; a transfer section that transfers the medium after recording to an adjacent unit that is provided adjacent to the transfer section; a first discharge section that discharges the medium after recording without transferring to the adjacent unit; a switching section that switches a transport destination of the medium after recording between the transfer section and the first discharge section; an inversion path for inverting the medium from a first surface of the medium to a second surface of the medium after recording on the first surface; and a controller that controls an operation related to recording on the medium and transport of the medium, in which the controller causes the medium on which recording is performed on the first surface by the recording section to wait for a predetermined wait time, then performs recording on the second surface of the inverted medium via the inversion path, and the predetermined wait time is shorter in a case where the transport destination of the medium after recording on the second surface is the transfer section than in a case where the transport destination of the medium after recording on the second surface is the first discharge section.

In the recording apparatus, in a case where the transport destination of the medium after recording is the transfer section, since the medium after recording is transferred to the adjacent unit through the recording apparatus, a transport distance or transport time until the medium is discharged out of the apparatus is different from the transport distance or transport time in a case where the medium is discharged from the first discharge section of the recording apparatus (normally, the transport distance and transporting time become longer by the time to pass though the adjacent unit).

At this time, with respect to the medium on which recording conditions (conditions for the ejecting amount of liquid and the like) are the same as each other, in a case where the medium is sent to the transfer section and in a case where the same medium is sent to the first discharge section with the same wait time, the drying states of the recording surface finally discharged to the outside of the apparatus are different from each other due to the difference of the transport distances or transport times between the above two cases. For example, when the transport destination of the medium after recording is the transfer section, since the medium is discharged out of the apparatus through the transport time and transport distance being longer than in a case where the transport destination of the medium is the first discharge section, the medium is firmly dried, on the other hand, drying may be possible without lengthening the wait time.

According to this configuration, since there is the wait time for drying the first surface of the medium on which recording is performed, and wait time change control is executed to change the wait time according to whether the transport destination of the medium after recording is the transfer section or the first discharge section, in a case where, for example, the transport destination of the medium after recording is the transport destination (transfer section) in which the transport distance or transport time until discharge out of the apparatus is lengthened, it is possible to dry the medium with good efficiency by shortening the wait time and thereby improve recording throughput. Note that, the wait time in the wait time change control may be 0 (zero), and it is also possible to discharge the medium without a wait time.

In the recording apparatus, the controller executes the wait time change control in a case where ejecting amount of the liquid from the recording section with respect to the first surface of the medium exceeds a predetermined threshold.

According to this configuration, it is possible to effectively obtain the effects of the first aspect in a case where the ejecting amount of the liquid from the recording section with respect to the first surface of the medium exceeds the predetermined threshold.

In the recording apparatus, the recording section is configured to perform recording by ejecting the liquid such as water-based ink on the medium.

According to this configuration, the recording section obtains the same effects as described above in the recording apparatus in which the recording section performs recording by ejecting the liquid such as water-based ink on the medium.

According to another aspect of the invention, there is provided a recording system that includes: a recording unit that is provided with a recording section that performs recording by ejecting liquid on a medium; a post-processing unit that executes post-processing on the medium on which recording is executed in the recording unit; and a relay unit provided adjacent to the recording unit and transporting the medium from the recording unit to the post-processing unit, in which the recording unit is provided with a transfer section that transfers the medium after recording to the relay unit, a first discharge section that discharges the medium after recording without transferring to the relay unit, a switching section that switches a transport destination of the medium after recording between the transfer section and the first discharge section, and a controller that controls an operation related to recording that includes transport of the medium and operation of the switching section in the recording unit, the controller causes the medium on which recording is performed on the first surface by the recording section to wait for a predetermined wait time, then performs recording on the second surface of the inverted medium via the inversion path, and the predetermined wait time is shorter in a case where the transport destination of the medium after recording on the second surface is the transfer section than in a case where the transport destination of the medium after recording on the second surface is the first discharge section.

According to this configuration, in the recording unit, since there is the wait time for drying the first surface of the medium on which recording is performed, and wait time change control is executed on the wait time according to whether the transport destination of the medium after recording is the transfer section or the first discharge section, in a case where, for example, the transport destination of the medium after recording is the transport destination (transfer section) in which the transport distance or transport time until discharge out of the recording system is lengthened, it is possible to dry the medium with good efficiency by shortening the wait time and thereby improve recording throughput in the recording system. The wait time in the wait time change control may be 0 (zero), and it is also possible to discharge the medium without a wait time.

In the recording system, as a transport path of the medium after recording, a first transport path that is a path from a downstream side of the recording section up to the first discharge section, and a second transport path that is a path from the downstream side of the recording section passing through the transfer section up to a second discharge section through which the medium on which post-processing is executed in the post-processing unit is discharged, are provided, and the second transport path is formed to be longer than the first transport path.

According to this configuration, since the second transport path is formed to be longer than the first transport path, in a case where the medium after both-surface recording is transported on the second transport path, that is, in a case where the transport destination of the medium is the transfer section, it is possible to set a drying time of the medium to be a transport time that is long as the length that the second transport path is longer than the first transport path. Then, it is possible to realize both effective drying of the medium and improvement of throughput in the recording system by shortening the wait time when the medium is transported through the second transport path.

In the recording system, when the medium after recording by the recording section is discharged from the first discharge section, the controller does not perform a switchback operation in which a transport direction of the medium is inverted in the first transport path, and when the medium is discharged from the second discharge section, the controller performs the switchback operation at least once in the second transport path.

According to this configuration, when the medium after recording by the recording section is discharged from the first discharge section, the controller does not perform a switchback operation in which the transport direction of the medium is inverted in the first transport path, and when the medium is discharged from the second discharge section, the controller performs the switchback operation at least once in the second transport path, therefore it is possible to further lengthen a time (transport time) until the medium is discharged from the second discharge section, and thereby further lengthen a drying time of the medium, and thus it is possible to suitably perform post-processing of the post-processing unit.

In the recording system, the second transport path is configured with a recording unit path that passes through the recording unit, a relay unit path that passes through the relay unit, and a post-processing unit path that passes through the post-processing unit, and the relay unit path includes a switchback path on which the switchback operation is executed.

According to this configuration, it is possible to perform switchback operation in the relay unit path.

In the recording system, the controller executes a posture correction operation in which the medium abuts against a medium transport means in a state of being stopped at the further downstream side than the switchback path of the relay unit path, and until performing the posture correction operation after sending out the medium from the switchback path, the medium is transported at a lower speed than a medium transport speed when the posture correction operation is performed.

According to this configuration, the controller executes a posture correction operation in which the medium abuts against a medium transport means in a state of being stopped further at the downstream side than the switchback path of the relay unit path, and until performing the posture correction operation after sending out the medium from the switchback path, the medium is transported at a lower speed than a medium transport speed when the posture correction operation is perform, therefore it is possible to increase drying reliability of the medium by the low speed transport state. Thereby, it is possible to increase alignment of the medium on the discharge destination (for example, discharge tray and the like) of the medium that is discharged from the second discharge section.

In the recording system, the relay unit path is provided with at least two switchback paths.

According to this configuration, in a case where recording is continuously performed on a plurality of media, it is possible to use a different switchback path from, for example, the preceding medium and the subsequent medium. Thereby, it is possible to shorten a gap between the preceding medium and the subsequent medium, and it is possible to secure the drying time while suppressing a reduction of throughput.

In the recording system, the controller accelerates the transport speed of the medium after the posture correction operation more than the transport speed before the posture correction operation.

In a case where continuous recording is performed on a plurality of media, when the posture correction operation is performed (the medium is temporarily stopped) on the preceding medium, a gap between the preceding medium and the subsequent medium is clogged.

According to this configuration, the controller accelerates the transport speed of the medium after the posture correction operation more than the transport speed before the posture correction operation, therefore it is possible to widen the gap between the preceding medium and the subsequent medium that is clogged by the posture correction operation, and secure a suitable gap between the preceding medium and the subsequent medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
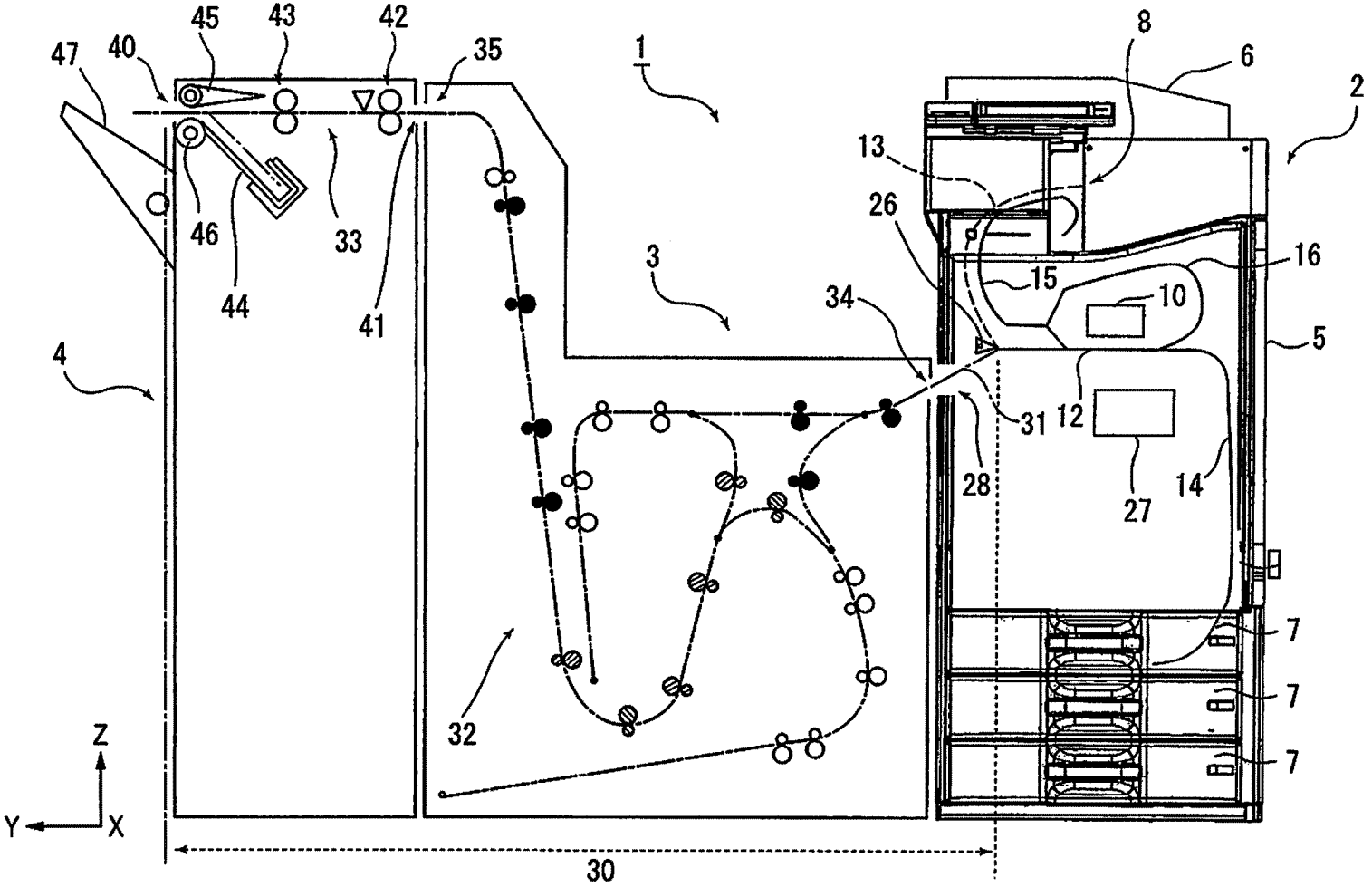
FIG. 1 is a schematic diagram of a recording system according to the invention.

Embodiments of the invention will be described below with reference to the drawings. Note that, where the configuration is the same in the respective embodiments, the same reference numerals are given, only the first example is described, and description is omitted for configurations in subsequent examples.

Figure 2:
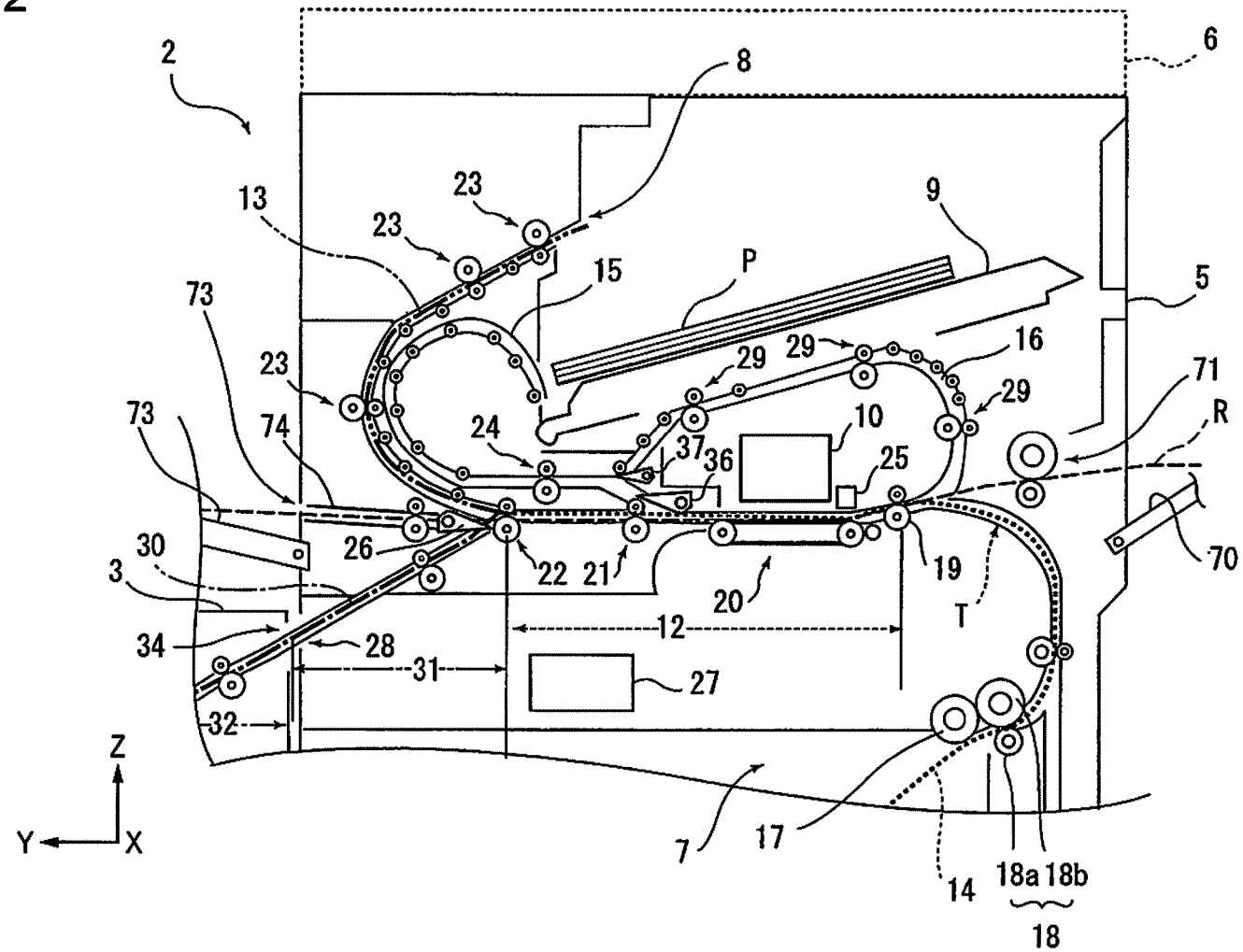
FIG. 2 is a schematic diagram illustrating a transport path of a recording unit.
Figure 3:
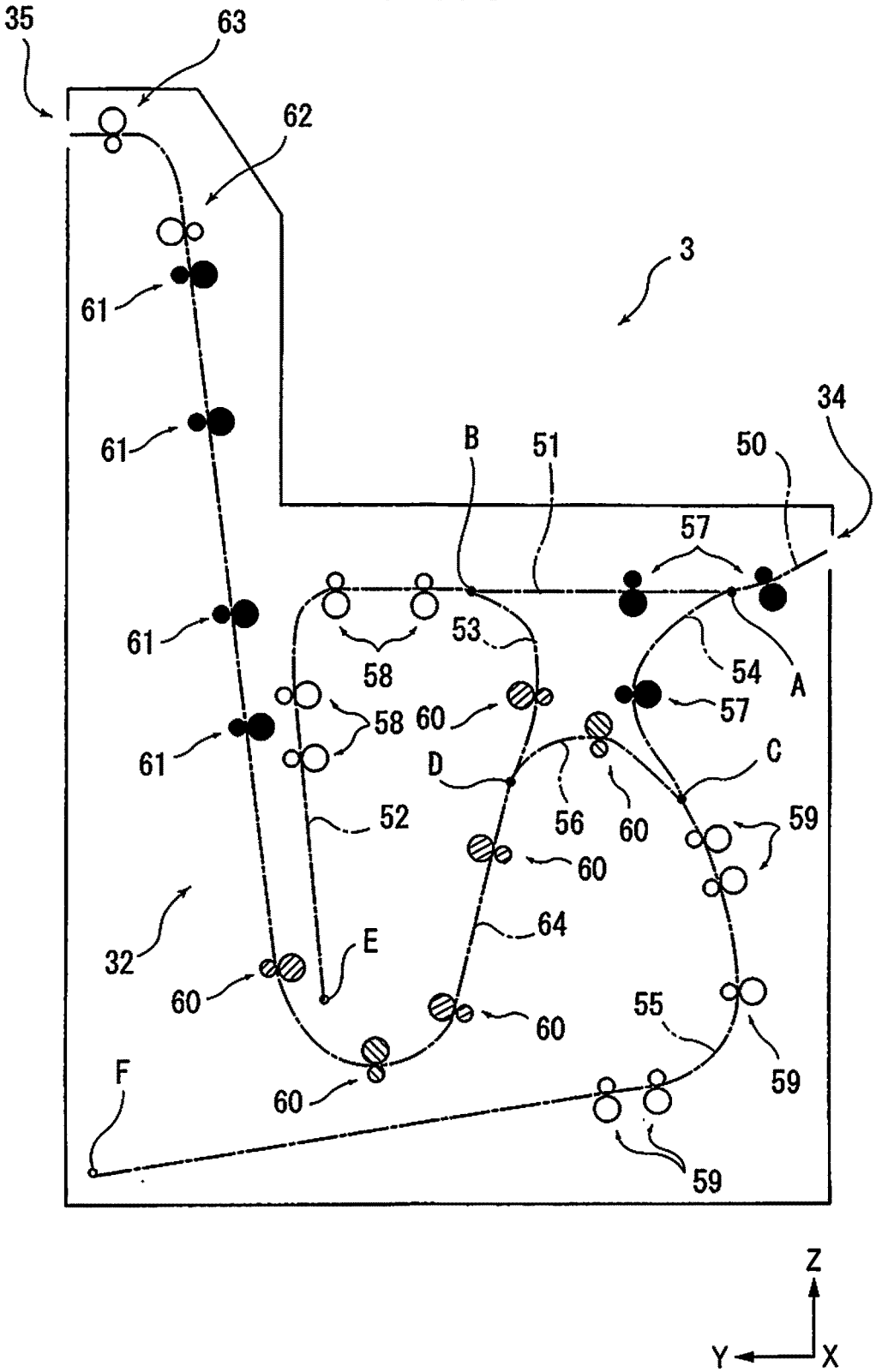
FIG. 3 is a schematic diagram illustrating a transport path of a relay unit.
Figure 4:
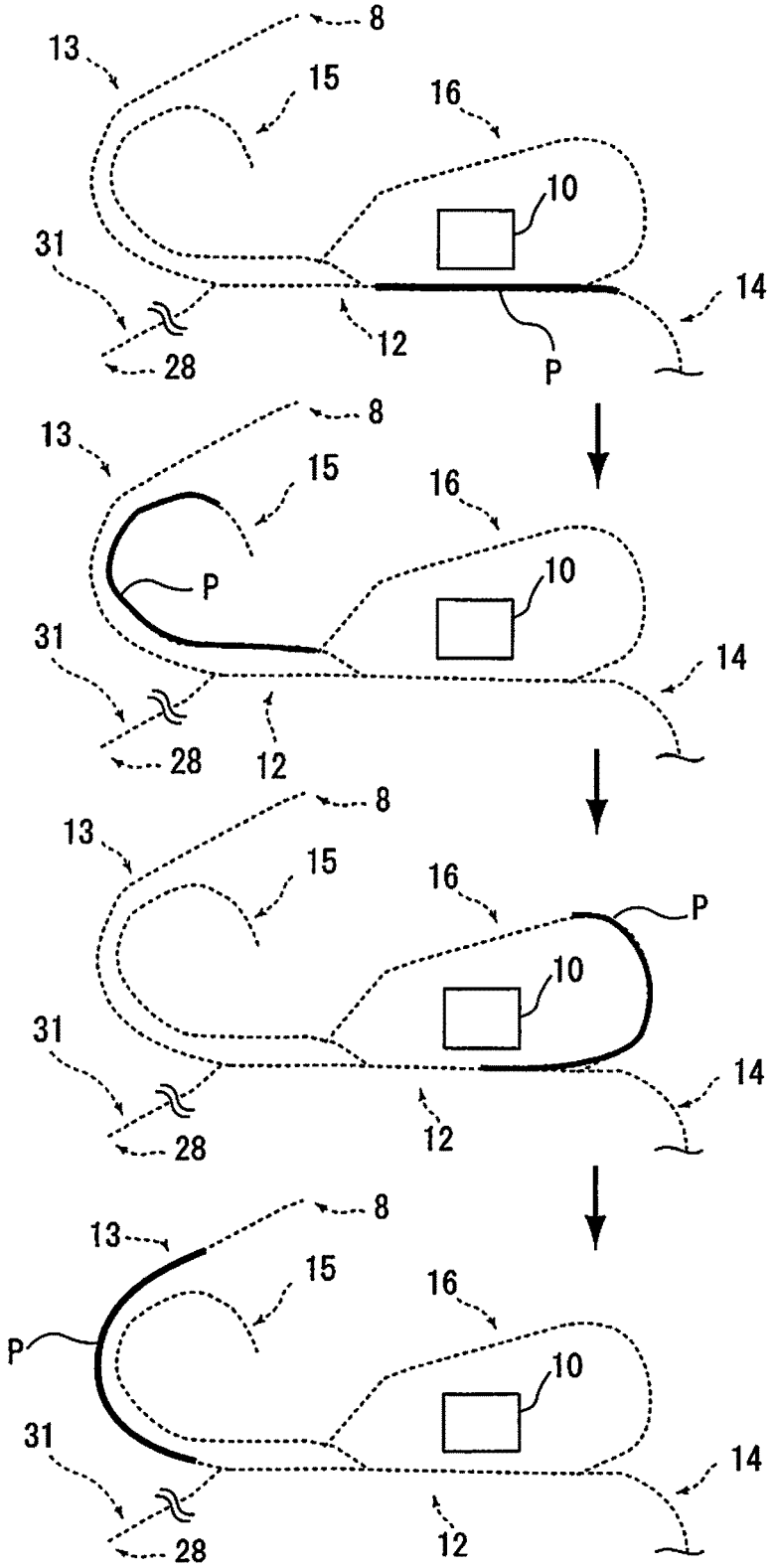
FIG. 4 is a diagram that describes a transport path during both-surface recording.
Figure 5:
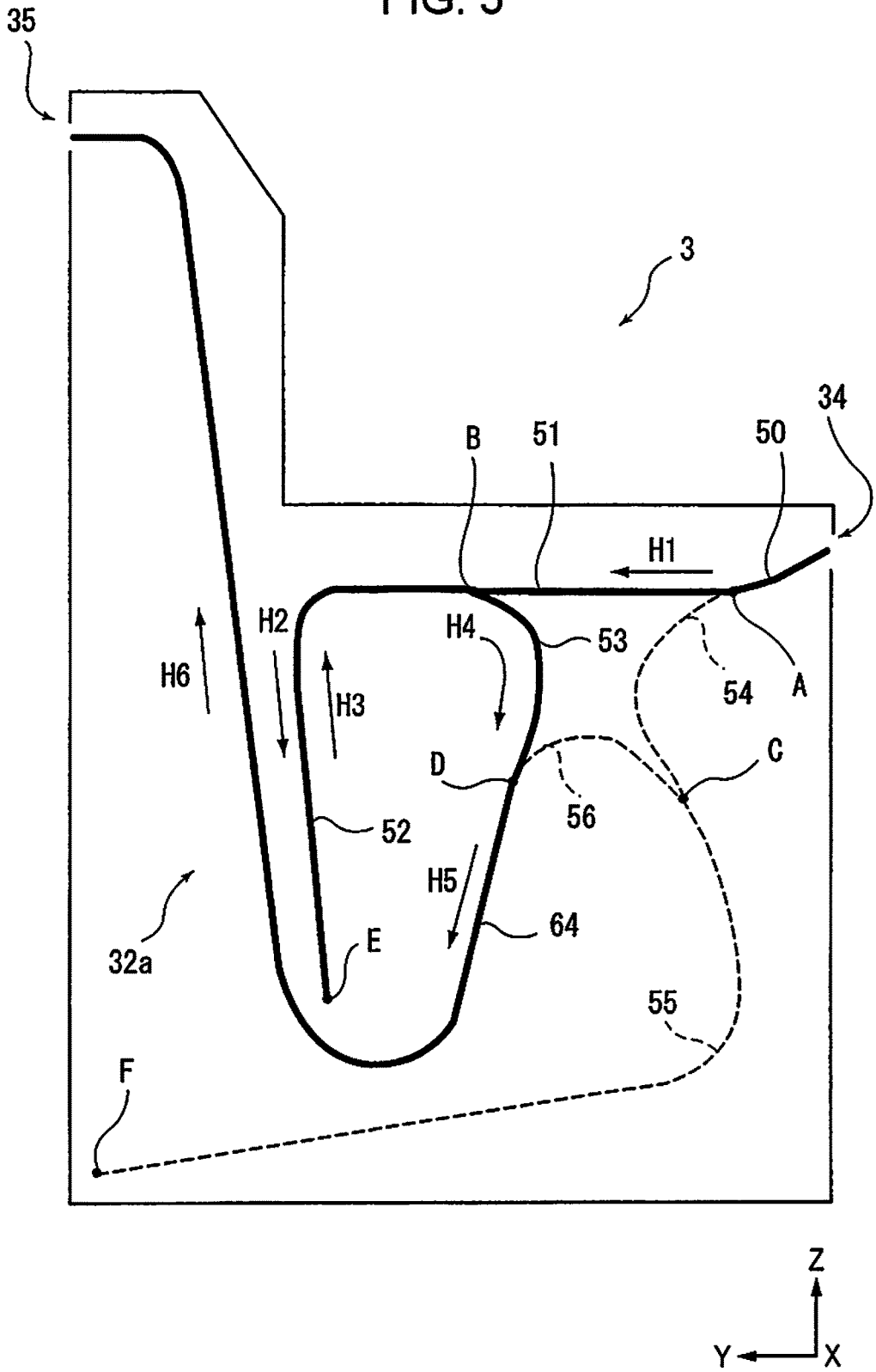
FIG. 5 is a schematic diagram illustrating a first path on a relay unit path.
Figure 6:
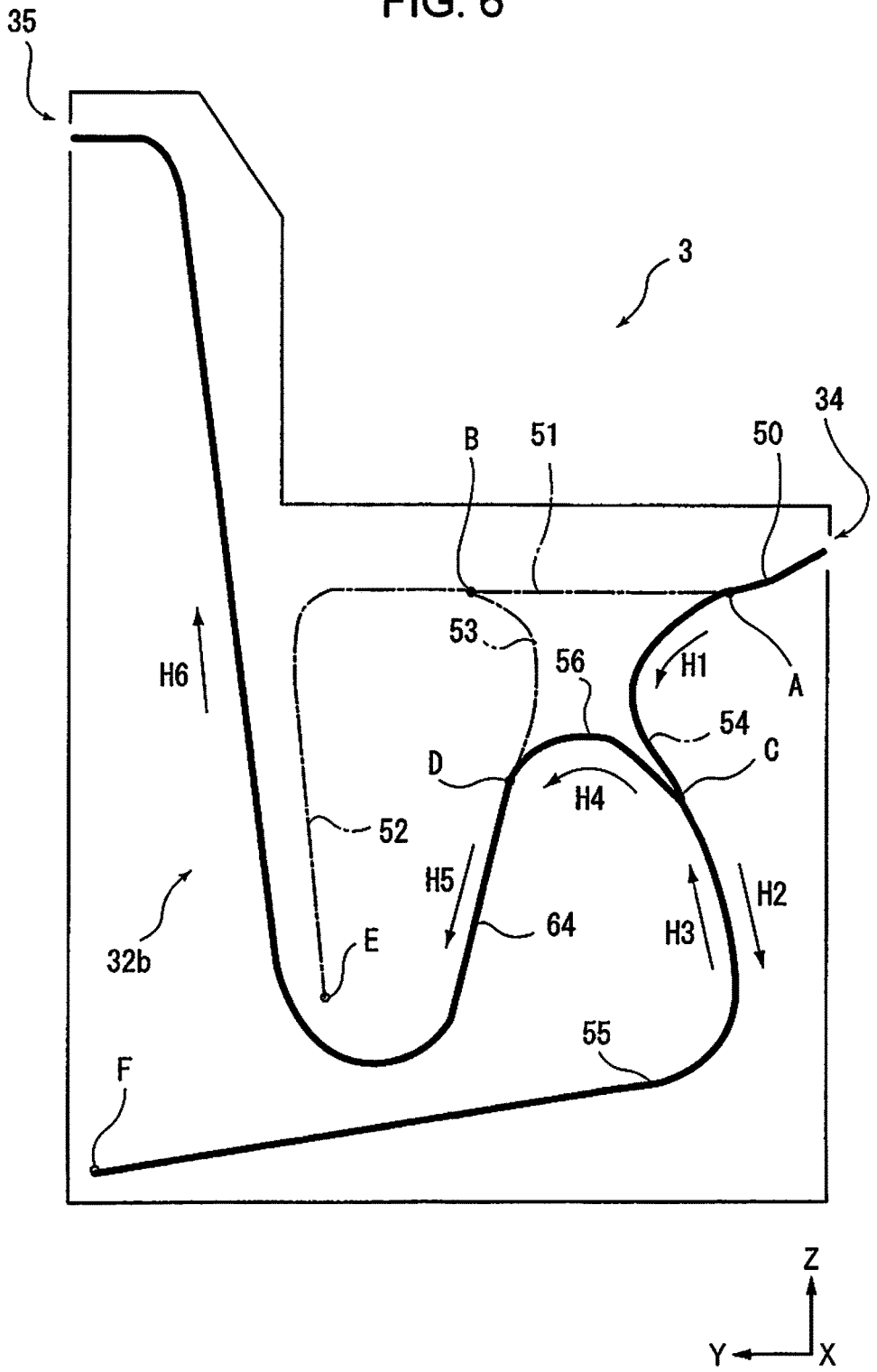
FIG. 6 is a schematic diagram illustrating a second path on the relay unit path.
Figure 7:
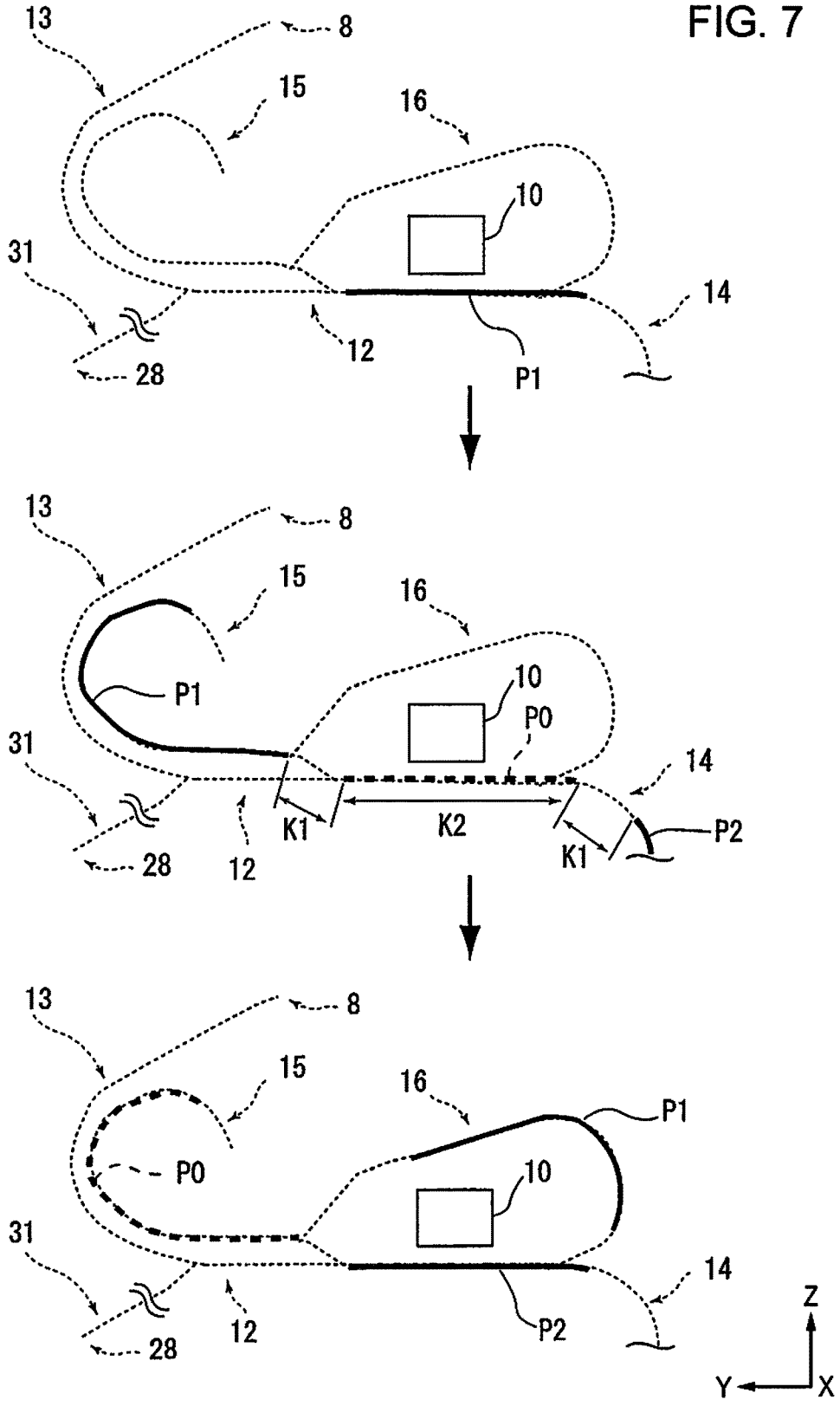
FIG. 7 is a diagram that describes a transport path in a case where both-surface recording is performed on a preceding medium and a subsequent medium.
Figure 8:
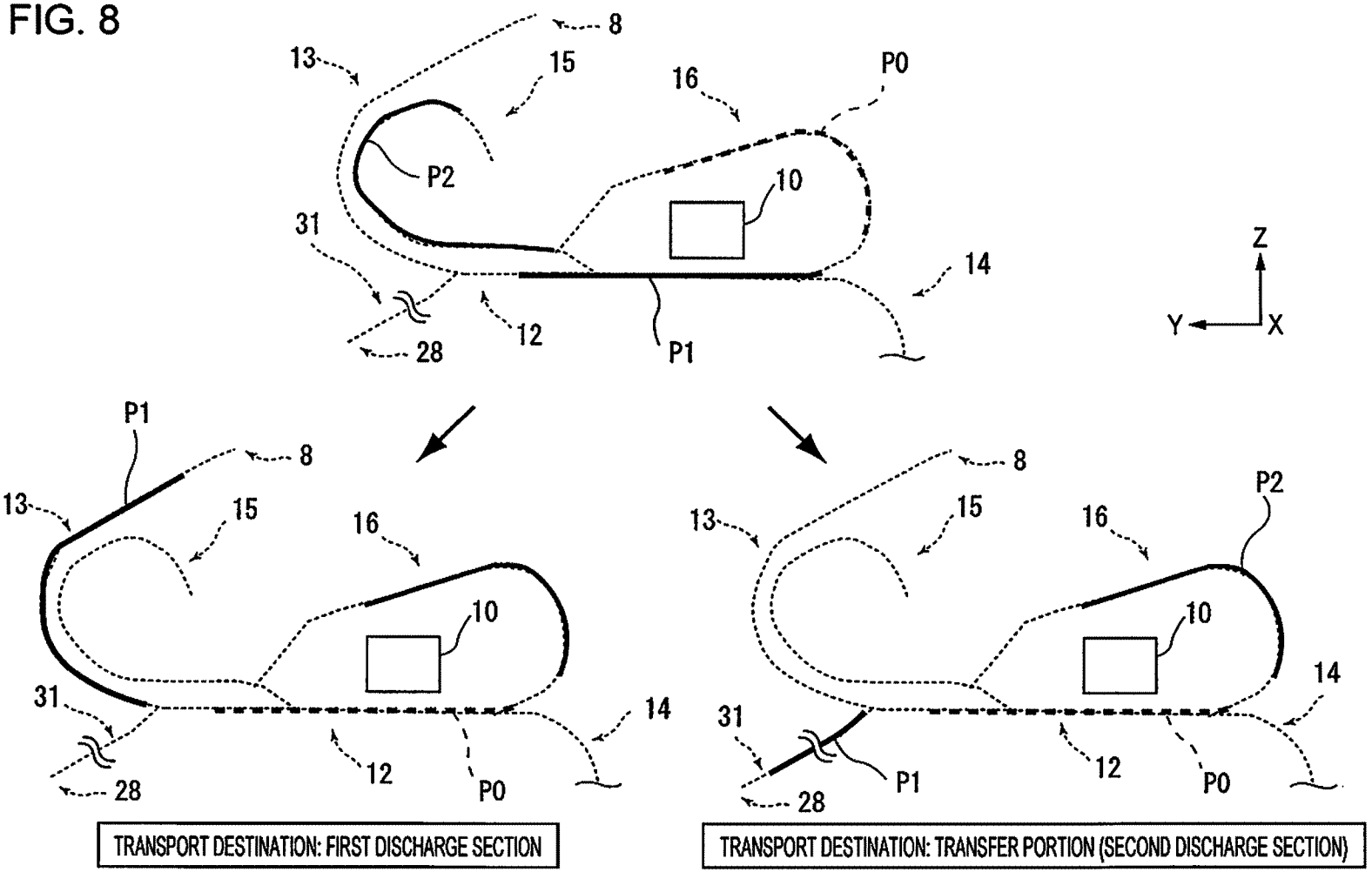
FIG. 8 is a diagram that describes a transport path in a case where both-surface recording is performed on a preceding medium and a subsequent medium.

FIG. 1 is a schematic diagram of a recording system according to the invention. FIG. 2 is a schematic diagram illustrating a transport path of a recording unit. FIG. 3 is a schematic diagram illustrating a transport path of a relay unit. FIG. 4 is a diagram that describes a transport path during both-surface recording. FIG. 5 is a schematic diagram illustrating a first path on a relay unit path. FIG. 6 is a schematic diagram illustrating a second path on a relay unit path. FIG. 7 is a diagram that describes a transport path in a case where both-surface recording is performed on a preceding medium and a subsequent medium. FIG. 8 is a diagram that describes a transport path in a case where both-surface recording is performed on a preceding medium and a subsequent medium.

In addition, in the X-Y-Z coordinates indicated in each diagram, an X axis direction is a width direction of a recording medium and indicates a device depth direction, a Y axis direction is a transport direction of the recording medium on a transport path in the recording apparatus and indicates a device width direction, and a Z axis direction indicates a device height direction.

Outline of Recording System

A recording system 1 indicated in FIG. 1 is provided with a recording unit 2 as a "recording apparatus" that performs recording on a paper sheet as a "medium", a relay unit 3, and a post-processing unit 4. The recording system 1, for example, is provided with the recording unit 2, the relay unit 3, and the post-processing unit 4 in order from right to left in FIG. 1. Then, there is a configuration in which it is possible to transport the medium from the recording unit 2 to the post-processing unit 4 by connecting the devices to each other. In the present embodiment, the relay unit 3 is an "adjacent unit" that is provided adjacent to the recording unit 2 (recording apparatus).

The recording system 1 is configured to be able to input a recording operation or the like on a medium in the recording unit 2, the relay unit 3, and the post-processing unit 4 from an operation panel (omitted from the drawings) that is provided in the recording unit 2.

Hereinafter, an outline configuration of each of the recording unit 2, the relay unit 3, and the post-processing unit 4 will be described in order.

Recording Unit

The recording unit 2 (FIG. 1) is configured as a multi-function printer that is provided with a scanner portion 6 and a printer portion 5 which is provided with a line head 10 (FIG. 2) as a "recording section" that performs recording by ejecting ink as an example of "liquid" on a paper sheet. In the embodiment, the ink is a water-based ink such as aqueous ink, and the printer portion 5 is a so-called ink jet printer.

The recording unit 2 is configured to be able to perform both-surface recording in which recording is performed on the second surface (also referred to as a rear surface) by inverting the paper sheet after recording on the first surface (also referred to as a front surface) of the paper sheet.

A plurality of paper sheet accommodating cassettes 7 are provided on the device lower portion of the recording unit 2 (FIG. 1). The recording operation is performed by sending the paper sheet that is accommodated in the paper sheet accommodating cassettes 7 toward the line head 10. There is a configuration such that the paper sheet after recording by the line head 10 is discharged by either of a first discharge section 8 that is provided in the recording unit 2 or a second discharge section 40 that is provided in the post-processing unit 4.

In a case where the paper sheet after recording is discharged from the second discharge section 40, the paper sheet is sent from the transfer section 28 to the relay unit 3, further, the paper sheet is sent to the post-processing unit 4 via the relay unit 3 and post-processing such as cutting and stapling is performed in a post-processing portion 44, then the paper sheet is discharged from the second discharge section 40.

Note that, a paper sheet transport path in the printer portion 5 will be described later.

Relay Unit

The relay unit 3 (FIG. 1) is configured so as to be disposed between the recording unit 2 and the post-processing unit 4, receive the paper sheet that is transferred from the transfer section 28 using an upstream side relay portion 34 and transport the paper sheet after recording from the recording unit to the post-processing unit 4.

In addition, the relay unit 3 dries the paper sheet by performing transport over a predetermined period on the paper sheet. Thereby, it is possible to gain transport time for the paper sheet.

The paper sheet that is transported within the relay unit 3 is sent within the post-processing unit 4 via a receiving portion 41 of the post-processing unit 4 from a downstream side relay portion 35 that is provided in the relay unit 3.

The paper sheet transport path in the relay unit 3 will be described later, along with the paper sheet transport path in the printer portion 5.

Post-Processing Unit

In addition, the post-processing unit 4 (FIG. 1) is configured so as to perform post-processing on the paper sheet that is recorded in the recording unit 2. Cutting, paper folding, punch drilling, stapling, sorting, and the like are exemplified as the post-processing that is performed in the post-processing unit 4. The paper sheet transport path in the recording unit 2 and the paper sheet transport path in the relay unit 3 will be described in order below.

Medium Transport Path of Recording Unit

Next, the paper sheet transport path in the recording unit 2 will be described using FIG. 2.

In FIG. 2, a dotted line indicated by reference numeral T indicates a portion of the paper sheet transport path from the paper sheet accommodating cassette 7. The paper sheet transport path T is configured to be provided with a feeding path 14 that sends the paper sheet that is picked up from the paper sheet accommodating cassette 7, and a straight path 12 that is connected to the feeding path 14 and includes a recording region by the line head 10.

Furthermore, a recording unit path 31 (indicated by a dashed line in FIG. 2) that is configured by a first transport path 13 (indicated by a two-dot chain line in FIG. 2) along which the paper sheet is sent to the first discharge section 8 and a second transport path 30 (FIG. 1) that is a path that passes through the transfer section 28 and reaches the second discharge section 40 (FIG. 1) is provided on the downstream side of the straight path 12.

The first transport path 13 and the second transport path 30 are both transport paths for the paper sheet after recording. The first transport path 13 is a path from the downstream side of the line head 10 up to the first discharge section 8. The second discharge section 40 is a discharge section that discharges a paper sheet on which the post-processing is executed in the post-processing unit 4.

Note that, in the embodiment, the second transport path 30 is a path with a longer configuration than the first transport path 13.

A switching section 26 of a guide flap and the like that switches the transport destination of the paper sheet after recording between the transfer section 28 and the first discharge section 8 in a connecting portion of the straight path 12, the first transport path 13, and the recording unit path 31 (second transport path 30). In other words, there is a configuration in which the paper sheet is switched to be sent to the first transport path 13 or to be sent to the recording unit path 31 (second transport path 30) by the switching section 26. The switching section 26 controls the operation by a controller 27. Note that, the controller 27 controls the operations related to recording including transport of the paper sheet and the operation of the switching section 26 in the recording unit 2.

Firstly, transport of the paper sheet from the paper sheet accommodating cassette 7 up to the first discharge section 8, and subsequently, transport of the paper sheet when both-surface recording is performed will be described below. Further after that, in a case where the paper sheet after recording is transported to the second discharge section 40 via the relay unit 3 will be described.

Paper Sheet Transport Path from Paper Sheet Accommodating Cassette Up to First Discharge Section A feeding roller 17 and a pair of separation rollers 18 that separate a plurality of paper sheets one sheet at a time are provided in that order along the medium transport direction in the feeding path 14.

The feeding roller 17 is configured to be rotatably driven by a driving source which is not shown in the drawings. In addition, the pair of separation rollers 18 is also referred to as a retard roller, and is configured so as to be provided with a driving roller 18*a* that sends the paper sheet toward the straight path 12 which will be described later and a driven roller 18*b* that nips the paper sheet with the driving roller 18*a* a separates the paper sheets.

The plurality of paper sheets are able to be accommodated in the paper sheet accommodating cassette 7, and the top paper sheet is picked up by the feeding roller 17 and is transported to the transport direction downstream side. At this time, in a case where the top paper sheet and the subsequent paper sheet are transported, the top paper sheet and the subsequent paper sheet are separated by the pair of separation rollers 18 and only the top paper sheet is sent to the feeding path 14.

A pair of resist rollers 19 that are provided on the upstream side of a belt transport means 20 which will be described later are provided on the downstream side in the transport direction of the pair of separation rollers 18.

In the present applied example, the feeding path 14 and the straight path 12 are connected at a position of the pair of resist rollers 19.

The straight path 12 is configured as a path that extends in a substantially straight line shape, and the belt transport means 20, a static eliminating portion 25, and the line head 10 are provided on the downstream side of the pair of resist rollers 19.

In the embodiment, the belt transport means 20 is disposed in a region that faces a head surface of the line head 10, and supports the opposite side from the recording surface of the paper sheet.

When the paper sheet is transported to the position that faces the line head 10 on the belt transport means 20, the line head 10 is configured so as to execute recording by ejecting ink as "liquid" on the recording surface of the paper sheet. The line head 10 is a recording head which is provided such that the nozzle which discharges ink covers the entire width of the paper sheet, and is configured as a recording head which is able to record over the entire width of the medium without accompanying movement in the medium width direction.

Note that, the recording unit 2 of the applied example is provided with the line head 10, but may be provided with a serial recording head that performs recording by ejecting liquid on the medium while reciprocally moving in a direction that intersects with the medium transport direction by being installed in the carriage.

The paper sheet that is transported on the straight path 12 is subsequently sent to the first transport path 13. The first transport path 13 is a transport path that has a curve that is connected to the straight path 12 on the downstream side of the line head 10, and is a path that sends the paper sheet so as to discharge from the first discharge section 8 with the recording surface of the paper sheet that is recorded by the line head 10 facing down.

The paper sheet that enters the first transport path 13 is transported by a pair of transport rollers 21 and 22 and a transport roller group 23, and is placed on a medium placement portion 9 with the recording surface facing down while being discharged from the first discharge section 8.

Transport Path During Both-Surface Recording

The recording unit 2 is configured to be able to execute both-surface recording as described above, and is provided, on the downstream side of the line head 10, with a switchback path for both-surface recording 15 that is branched from the straight path 12 further on the upstream side (in FIG. 2 in the embodiment, the upstream side of the pair of transport rollers 21) than the first transport path 13 and an inversion path 16 that is connected to the switchback path for both-surface recording 15 and inverts the front and rear (first surface and second surface) of the paper sheet and returns to the straight path 12. Note that, each of guide flaps 36 and 37 (FIG. 2) are provided on a connecting portion of the straight path 12 and the switchback path for both-surface recording 15 and a connecting portion of the switchback path for both-surface recording 15 and the inversion path 16, and the path along which the paper sheet is sent is switched by switching the guide flaps 36 and 37. Note that, the operations of the guide flaps 36 and 37 are controlled by the controller 27. In addition, a transport timing at which the belt transport means 20 and various pairs of transport rollers are driven is also controlled by the controller 27.

When both-surface recording is performed by the line head 10, the controller 27 performs recording on the second surface by inverting the paper sheet on which recording on the first surface is performed after the paper sheet is caused to wait for a predetermined wait time.

Specifically, recording is performed on the first surface (diagram at the top of FIG. 4), and the paper sheet after recording (indicated by reference numeral P in FIG. 4) is sent from the straight path 12 to the switchback path for both-surface recording 15 (diagram second from the top in FIG. 4).

A paper sheet P is caused to wait for a predetermined wait time since recording on the first surface is dried in the switchback path for both-surface recording 15. Note that, a feature of a change of the wait time in the switchback path for both-surface recording 15 according to the transport destination of the paper sheet after both-surface recording is a characteristic part of the invention. This feature will be described later.

The paper sheet P (diagram two from the top in FIG. 4) that is caused to wait for a predetermined wait time by the switchback path for both-surface recording 15 is sent in an opposite direction (−Y axis direction) from a direction (+Y axis direction) that is fed to the switchback path for both-surface recording 15 by the pair of transport rollers 24 (FIG. 2) and enters the inversion path 16, and the recording surface is inverted, the paper sheet enters the straight path 12 again, and recording is performed on the second surface by the line head 10 (diagram second from the bottom in FIG. 4). Note that, the reference numeral 29 in FIG. 2 is a pair of transport rollers that are provided in the inversion path 16.

The paper sheet P on which recording is performed on both surfaces enters the first transport path 13 from the straight path 12, and is discharged from the first discharge section 8 and is placed in the medium placement portion 9 (FIG. 2) (diagram at the bottom in FIG. 4).

Control of Wait Time During Both-Surface Recording in Recording Unit

As described above, when both-surface recording is performed by the line head 10, when recording on the second surface is started after recording on the first surface, since recording on the first surface is dried, in the switchback path for both-surface recording 15, that is, in a state of the diagram two from the top in FIG. 4, the paper sheet P is caused to wait for a predetermined wait time.

Then, the controller 27 executes "wait time change control" that changes the wait time in the switchback path for both-surface recording 15 according to whether the transport destination of the paper sheet P after both-surface recording is the transfer section 28 or is the first discharge section 8.

In more detail, the controller 27 sets the wait time in a case where the transport destination of the paper sheet after both-surface recording is the transfer section 28, that is, in a case of passing through the second transport path 30 to be shorter than in a case where the transport destination is the first discharge section 8, that is, in a case of passing through the first transport path 13.

In the recording unit 2, the transport destination of the paper sheet P after recording is the transfer section 28, and in a case where the second transport path 30 is transported, the paper sheet P passes through the relay unit 3 and is sent to the post-processing unit 4. Out of the second transport path 30, the transport path of the relay unit 3 (relay unit path 32) is formed to be long in order to secure a drying time in the manner described later.

Accordingly, the transport distance or transport time up to the paper sheet P being discharged to the outside of the recording system 1 is longer than the transport distance or transport time in a case where the paper sheet P that passes through the first transport path 13 is discharged from the first discharge section 8.

At this time, in a case where conditions for both-surface recording (for example, ejecting amount of ink on the first surface) on the same paper sheet is sent to the transfer section 28 (the final transport destination is a second discharge section 40) with the same wait time and in a case where the paper sheet is sent to the first discharge section 8, the drying states of the recording surface while discharging to the outside of the recording system 1 are different. That is, when the transport destination of the paper sheet after recording is the transfer section 28, since the paper sheet is discharged to the outside of the recording system 1 through the transport time and transport distance being longer than in a case where the transport destination of the paper sheet is the first discharge section 8, the paper sheet P is firmly dried.

However, from another perspective, in a case where it is possible to dry during transport on the long second transport path 30 without the wait time being long in the switchback path for both-surface recording 15, the wait time is wasted time.

Therefore, in the embodiment, the controller 27 changes the wait time in the switchback path for both-surface recording 15 according to the transport destination of the paper sheet after both-surface recording.

It is possible to effectively utilize the long second transport path 30 as a path for drying since the wait time in a case where the paper sheet transport destination is the transfer section 28 (the case of passing through the second transport path 30) is shorter than in a case where the transport destination is the first discharge section 8 (in a case of passing through the first transport path 13), and it is possible to realize both reliable drying of the paper sheet and improvement of throughput by shortening the wait time.

In addition, "wait time change control" by the controller 27 is effective when executing in a case where, in particular, the ejecting amount of ink onto the first surface from the line head 10 exceeds a predetermined threshold.

Since it takes a lot of time to dry a great ejecting amount of ink on the first surface, in a case of passing through the first transport path 13 that is a short transport path up to discharge to the outside of the apparatus, that is, a case of discharging to the first discharge section 8, it may not be possible to perform sufficient drying. Accordingly, in a case where the ejecting amount of ink onto the first surface is great, a longer time than the wait time in the switchback path for both-surface recording 15 is required.

Meanwhile, in a case where the transport path is lengthened up to discharge to the outside of the apparatus and it is possible to utilize the long transport distance (transport time) in drying, that is, in a case of discharging from the second discharge section 40 through the second transport path 30, the long wait time in the switchback path for both-surface recording 15 has greatly reduced throughput in the recording system 1.

In such a case, it is possible to effectively suppress the reduction of throughput in a case of being discharged from the second discharge section 40 through the long second transport path 30 by executing the "wait time change control" using the controller 27.

Note that, it is assumed that in a comparison of the wait time (for example, wait time t1) in a case where the transport destination is the first discharge section 8 and the wait time (for example, wait time t2 that is shorter than the wait time t1) in a case where the transport destination is the transfer section 28 (relationship of t1>t2), the ejecting amounts of ink on the recording surface of the paper sheet are substantially the same (for example, ejecting amount W1). That is, the relationship of t1>t2 (t2 includes the case of 0) is established between a drying time t1 according to the ejecting amount W1 of the ink onto the first surface from the line head 10 in a case where the transport destination is the first discharge section 8 and a drying time t2 according to the ejecting amount W1 of the ink onto the first surface from the line head 10 in a case where the transport destination is the transfer section 28.

For example, recording in which an ejecting amount W2 of ink is great (W2>W1: hereinafter, high duty recording) is performed such that a wait time T1 that is longer than the wait time t1 is required as the wait time in a case where the paper sheet transport destination is the first discharge section 8. The wait time in a case where the transport destination of the paper sheet of the high duty recording is the transfer section 28 is a wait time T2 that is shorter than the wait time T1, relationship of T1>T2 is established.

In this arrangement, when the ejecting amount W2 of ink in the high duty recording is greater than the ejecting amount W1, depending on the case, there are cases where t1>T2 is not established. However, under the condition of at least the ink ejecting amounts being the same, it is possible to effectively utilize the longer second transport path 30 as a path for drying since the wait time in a case where the paper sheet transport destination is the transfer section 28 is shorter than the wait time in a case where the transport destination is the first discharge section 8, and it is possible to realize both reliable drying of the paper sheet and improvement of throughput by shortening the wait time.

Therefore, it is possible to set the wait time in a case where the transport destination is the first discharge section 8 according to the printing duty and set such a predetermined time is subtracted in a case where the transport destination is the transfer section 28 as a reference for the wait time.

Note that, in the same manner as in the case where recording is performed on the second surface although recording is not performed on the first surface, the paper sheet P passes along the switchback path for both-surface recording 15 and the inversion path 16. In a case where recording is not performed on the first surface, it is possible to set a configuration in which the wait time in the switchback path for both-surface recording 15 is not taken.

In addition, in a case where recording is only performed on the first surface, control may be performed in which the paper sheet P after recording is not sent to the switchback path for both-surface recording 15. In this case, it is possible to set a configuration in which the wait time for drying the paper sheet P is taken at the upstream side of the switching section 26 that is a branched portion of the transport path (first transport path 13 and second transport path 30) according to the discharge destination. Path in case where Paper Sheet is sent to Second Discharge Section Via Relay Unit The second transport path 30 that is a paper sheet transport path in a case where the paper sheet after recording in the line head 10 is discharged from the second discharge section 40 will be described below.

The second transport path 30 is provided with the recording unit path 31, the relay unit path 32 that is the transport path in the relay unit 3, and the post-processing unit path 33 that is the transport path in the post-processing unit 4 described above.

The paper sheet after recording is sent from the transfer section 28 of the recording unit 2 to the relay unit 3. Specifically, the paper sheet after recording is sent to the recording unit path 31 (FIG. 2), passes through the transfer section 28, and enters the relay unit path 32 from the upstream side relay portion 34 of the relay unit 3.

The relay unit path 32 is described below with reference to FIG. 3. Note that, in each of the pair of transport rollers indicated in FIG. 3, the driving roller that is driven by the driving source such as a motor is illustrated by a large circle, and the driven roller that is drivably rotated is illustrated by a small circle. The driving of the driving roller of each of the pair of transport rollers is controlled by the controller 27 (FIG. 1 and FIG. 2), and the paper sheet is transported on the relay unit path 32.

The relay unit path 32 (FIG. 3) has a branch point A, a branch point B, and a branch point C at which the transport path is branched, a confluence point D at which the transport path converges, and an end portion E and an end portion F that are terminals of the transport path of the paper sheet. In addition, guide flap (omitted from the drawings) that is divided into the transport path of the paper sheet is provided in the branch point A, the branch point B, and the branch point C.

Furthermore, the relay unit path 32 is configured by an introduction path 50 (between upstream side relay portion 34 and branch point A), a first branched path 51 (between branch point A and branch point B), a first switchback path 52 (between branch point B and branch point E), a first confluence path 53 (between branch point B and confluence point D), a second branched path 54 (between branch point A and branch point C), a second switchback path 55 (between branch point C and end portion F), a second confluence path 56 (between branch point C and confluence point D), and a lead out path 64 (between confluence point D and downstream side relay portion 35).

A first transport roller group 57 is provided in the introduction path 50, the first branched path 51, and the second branched path 54. A second transport roller group 58 is provided in the first switchback path 52. A third transport roller group 59 is provided in the second switchback path 55. A fourth transport roller group 60 is provided on the upstream side on the transport direction of the paper sheet in the first confluence path 53, the second confluence path 56, and the lead out path 64. A fifth transport roller group 61, a pair of correction rollers 62, and a pair of discharge rollers 63 are provided on the downstream side on the transport direction of the paper sheet in the lead out path 64.

The pair of correction rollers 62 is an example of the "medium transport means" that corrects skew of the paper sheet in a case where skew (oblique motion) of the paper sheet in the transport direction occurs in the relay unit path 32. Specifically, in correcting skew of the paper sheet, the controller 27 is performed by executing "posture correction operation" that abuts against the paper sheet in the pair of correction rollers 62 (medium transport means) in a stopped state.

In the abutting of the paper sheet against the pair of correction rollers 62 in the stopped state, it is possible to effectively correct skew by performing an increase of paper sheet transport speed of the fifth transport roller group 61 at high speed.

The paper sheet in which oblique motion is corrected using "posture correction operation" is nipped by the pair of correction rollers 62, and is fed out to the downstream side relay portion 35.

The pair of correction rollers 62 is positioned at a downstream side in the transport direction with respect to the fifth transport roller group 61, and is disposed such that the tip end of the paper sheet reaches the downstream side relay portion 35 during transport by the pair of correction rollers 62. That is, the pair of correction rollers 62 are disposed close to the downstream side relay portion 35.

Note that, the second transport roller group 58 and the third transport roller group 59 are able to rotate in a forward direction or a reverse direction, and it is possible to invert the transport direction of the paper sheet in the first switchback path 52 and the second switchback path 55.

Next, flow of paper sheet transport in the relay unit path 32 will be described with reference to FIG. 5 and FIG. 6. Note that, FIG. 5 and FIG. 6 are diagrams that correspond to FIG. 3, illustration is omitted of constituent elements of a transport system such as the first transport roller group 57 to the fifth transport roller group 61, the pair of correction rollers 62, the pair of discharge rollers 63, and the like. Furthermore, in FIG. 5 and FIG. 6, a part that is used in transport of the paper sheet on the relay unit path 32 is indicated by a solid line, and the part that is not used in transport of the paper sheet on the relay unit path 32 is indicated by a broken line. In addition, in FIG. 5 and FIG. 6, arrows in the drawings indicate the transport direction of the paper sheet, and respective reference numerals H1 to H6 are applied.

The relay unit path 32 is able to transport the paper sheet of two paths of a first path 32*a* indicated in FIG. 5 (path that is indicated by a solid line in FIG. 5) and a second path 32*b* indicated in FIG. 6 (path that is indicated by a solid line in FIG. 6).

As indicated by the solid line in FIG. 5, the first path 32*a* on which the paper sheet is transported is configured by the introduction path 50, the first branched path 51, the first switchback path 52, the first confluence path 53, and the lead out path 64.

In the first path 32*a* (FIG. 5), the paper sheet that is sent from the upstream side relay portion 34 passes through the introduction path 50, advances on the first branched path 51 in a transport direction H1, and enters the first switchback path 52. The paper sheet that is transported to the first switchback path 52 advances in the direction of the transport direction H2, then the advancing direction of the paper sheet is inverted (switched back), advances in a transport direction H3 that is a reverse direction from the transport direction H2, and enters the first confluence path 53. Next, the paper sheet advances in a transport direction H4 in the first confluence path 53 and enters the lead out path 64, advances in a transport direction H5 and a transport direction H6 in the lead out path 64, and is transported out from the downstream side relay portion 35 toward the receiving portion 41 of the post-processing unit 4 (FIG. 1).

Meanwhile, the second path 32*b* indicated by the solid line in FIG. 6 is configured by the introduction path 50, the second branched path 54, the second switchback path 55, the second confluence path 56, and the lead out path 64.

In the second path 32*b*, the paper sheet that is transported out from the upstream side relay portion 34 passes through the introduction path 50, advances on the second branched path 54 in the transport direction H1, and is transported in the second switchback path 55. The paper sheet that is transported into the second switchback path 55 advances in the transport direction H2, then the advancing direction of the paper sheet is inverted (switched back), advances in the transport direction H2 and a transport direction H3 in a reverse direction, and is transported into the second confluence path 56. Next, the paper sheet advances in a transport direction H4 in the second confluence path 56 and is transported into the lead out path 64, advances in a transport direction H5 and a transport direction H6 in the lead out path 64, and is transported out from the downstream side relay portion 35 toward the receiving portion 41 of the post-processing unit 4 (FIG. 1).

In a case where recording is continuously performed on a plurality of paper sheets, in the paper sheet that is transported in from the upstream side relay portion 34, for example, the preceding medium on which recording is performed previously is guided to the first path 32*a* by the guide flap not illustrated that is provided at the branch point A. Next, the subsequent medium that is transported in from the upstream side relay portion 34 is guided to the second path 32*b* by the guide flap not illustrated that is provided at the branch point A.

Then, transport of the paper sheet by the first path 32*a* and transport of the paper sheet by the second path 32*b* are alternately repeated.

In the first transport path 13 (path that discharges the paper sheet after recording from the first discharge section 8) described above, the controller 27 does not perform a switchback operation in which the transport direction of the paper sheet is inverted in the first transport path 13, and the paper sheet is discharged out without change in the transport direction.

Meanwhile, a switchback operation is performed in the relay unit path 32 in a case where the paper sheet is discharged from the second discharge section 40 through the second transport path 30, therefore it is possible to configure so as to further lengthen the transport time and thereby further lengthen the drying time of the paper sheet, and thus it is possible to suitably perform post-processing using the post-processing unit 4.

Furthermore, the relay unit path 32 (first path 32*a* and second path 32*b*) is configured to include the first switchback path 52 and the second switchback path 55, therefore compared with a case where the first switchback path 52 and the second switchback path 55 are not included, it is possible to further lengthen the relay unit path 32. That is, the relay unit 3 according to the embodiment is configured to be able to increase transport capacity of the paper sheet while achieving space saving, and secure a longer drying time by lengthening the relay unit path 32.

In addition, in the manner of the embodiment, the relay unit path 32 is provided with at least two switchback paths (first switchback path 52 and second switchback path 55), thereby it is possible to configure the relay unit path 32 to have two transport paths (first path 32*a* and second path 32*b*), and it is possible to improve transport capacity of the paper sheet compared with a case where there is one transport path.

As described above, in a case where recording is continuously performed on a plurality of paper sheets, it is possible to use a different transport path from the preceding medium and the subsequent medium. Thereby, it is possible to shorten a gap between the preceding medium and the subsequent medium, and it is possible to secure the drying time while suppressing a reduction of throughput.

In the recording unit 2, when the ink from the line head 10 (water-based ink in the embodiment) is ejected on the paper sheet, moisture in the ink infiltrates the paper sheet and is absorbed. In the relay unit 3, moisture that is absorbed in the paper sheet is evaporated and the paper sheet is dried while the paper sheet is transported by the relay unit path 32. The relay unit path 32 (first path 32*a* and second path 32*b*) has a longer transport distance than the first switchback path 52 and the second switchback path 55, therefore, in a case where the transport distance is short, for example, it is possible to more suitably dry the ink that is adhered to the paper sheet compared with a case where the first transport path 13 of the recording unit 2 is transported.

Note that, in the first switchback path 52 or the second switchback path 55, before and after the advancing direction of the paper sheet is switched back, the position of the surface (for example, first surface) of the paper sheet is inverted with respect to the transport direction.

Therefore, while the paper sheet that is transported in from the upstream side relay portion 34 transports the first path 32*a* or the second path 32*b*, the front and rear (position on the first surface and the second surface) are inverted in the transport direction. Then, in a state in which the front and rear in the transport direction are inverted, the paper sheet is transported out from the downstream side relay portion 35 toward the post-processing unit 4 (FIG. 1).

The paper sheet that is transported out from the downstream side relay portion 35 is transported into the post-processing unit path 33 from the receiving portion 41 of the post-processing unit 4 that is shown in FIG. 1. The paper sheet that enters into the post-processing unit path 33 is sent by the pair of transport rollers 42 and 43 and the tip end side reaches the second discharge section 40. A guide flap 45 is provided in the vicinity of the upstream side of the second discharge section 40, the paper sheet is guided to the guide flap 45 and is stacked in the post-processing portion 44 with the paper sheet rear end side on the −Z axis direction side.

When the plurality (may be one) of paper sheets that are set in the post-processing portion 44 are stacked, post-processing (cutting, stapling process, or the like) is executed. The paper sheet or a paper sheet bundle after post-processing is executed is discharged in the +Y axis direction by the discharge roller 46, and is placed in a discharge tray 47.

Other Control by Controller

Other control by the controller 27 will be described below.

As described above, in a case where the controller 27 executes the "posture correction operation" that corrects skew of the paper sheet by abutting the paper sheet against the pair of correction rollers 62 (medium transport means) in a stopped state further on the downstream side than the switchback path of the relay unit path 32 (first switchback path 52 in a case where the paper sheet is transported on the first path 32*a*, and second switchback path 55 in a case where the paper sheet is transported on the second path 32*b*).

At this time, in the abutting of the paper sheet against the pair of correction rollers 62, preferably the transport speed is accelerated by the fifth transport roller group 61.

However, when the transport speed is increased by the fifth transport roller group 61, in a case where the relay unit path 32 is considered as a path for drying, there is a configuration in which the drying time is shortened.

In order to avoid such as case, in the relay unit path 32, the controller 27 performs control in which the paper sheet is transported at a lower speed than the paper sheet transport speed when a "posture correction operation" is performed until performing the "posture correction operation" by sending out the paper sheet from the switchback path (first switchback path 52 and second switchback path 55), that is, the paper sheet is transported by the fourth transport roller group 60.

Thereby, it is possible to configure so as to further dry the paper sheet when transporting at a low speed using the fourth transport roller group 60. Thereby, it is possible to increase reliably of drying of the paper sheet.

Additionally, the controller 27 is configured to accelerate the transport speed of the paper sheet after the "posture correction operation" by the pair of correction rollers 62 more than the transport speed before the "posture correction operation".

When recording is performed continuously on a plurality of paper sheets, when the "posture correction operation" is performed on the preceding medium, a gap between the preceding medium and the subsequent medium is clogged since the preceding medium is temporarily stopped by the "posture correction operation".

The transport speed of the paper sheet after the "posture correction operation" by the pair of correction rollers 62 is accelerated more than the transport speed before the "posture correction operation", therefore it is possible to widen the gap between the preceding medium and the subsequent medium that is clogged by the "posture correction operation", and secure a suitable gap between the preceding medium and the subsequent medium.

Other Configurations in Recording Unit

Other configurations in the recording unit 2 according to the applied example will be described.

The recording unit 2 (FIG. 2) is configured to be able to feed the paper sheet from a manual feed tray 70 other than in a case where recording is performed by feeding the paper sheet that is accommodated in the paper sheet accommodating cassette 7. In FIG. 2, a dotted line R indicates the transport path in a case of feeding from the manual feed tray 70.

The paper sheet that is fed from the manual feed tray 70 is sent by the pair of transport rollers 71, converges in the straight path 12, and recording is performed by the line head 10. In the case where both-surface recording is performed, after recording on the first surface, the paper sheet passes along the switchback path for both-surface recording 15 and the inversion path 16 and is inverted, and recording is performed on the second surface.

The paper sheet after recording transports the third transport path 74 that directly extends contiguous to the straight path 12, and is placed in the discharge tray 73 through the third discharge section 72.

In a case where both-surface recording is performed on the paper sheet that is fed from the manual feed tray 70, when the paper sheet after both-surface recording is discharged from the third discharge section 72, since the third transport path 74 is short, it is desirable to lengthen the wait time in the switchback path for both-surface recording 15.

It is also possible to configure to discharge from another discharge section (first discharge section 8 or second discharge section 40) by setting by the operation panel (omitted from the drawings) that is provided in the recording unit 2. In that case, it is possible to set the wait time according to the transport destination of the paper sheet after both-surface recording.

In the embodiment, the recording system 1 is configured by combining the individual recording unit 2, relay unit 3, and post-processing unit 4, but it is also possible to set the recording system 1 such that the recording unit 2, relay unit 3, and post-processing unit 4 are integrally configured.

In addition, when the relay unit or post-processing unit of configuration other than the relay unit 3 and the post-processing unit 4 are connected, the recording unit 2 is configured to be able to execute various control that starts "wait time change control" by control by the controller 27.

Transport Path in Case where Both-Surface Recording is Performed on Preceding Medium and Subsequent Medium In the recording unit 2, a preceding medium P1 that is a paper sheet that is transported first and paper sheet transport in a case where both-surface recording is performed on the subsequent medium P1 that is a paper sheet that is transported subsequently to the preceding medium P1 will be described below with reference to FIG. 7 and FIG. 8.

First, as shown in top diagram in FIG. 7, the preceding medium P1 is sent from the feeding path 14 to the straight path 12, and recording is performed on the first surface by the line head 10.

As shown in the middle diagram in FIG. 7, after recording on the first surface ends, the preceding medium P1 is sent to the switchback path for both-surface recording 15 and the wait time for drying the first surface is taken, and the subsequent medium P2 is sent from the feeding path 14.

In the middle diagram in FIG. 7, a gap between the rear end of the preceding medium P1 and the tip end of the subsequent medium P2 is provided with a gap corresponding to one paper sheet (indicated by a thick dotted line in the middle diagram in FIG. 7) that is excessive in comparison with during normal recording in which only recording on the first surface is performed. Specifically, a distance is spaced in which a distance K1 between the preceding medium P1 and the subsequent medium P2 during the normal recording is added to the front and rear (upstream and downstream) of a gap K2 corresponding to one paper sheet (K1+K2+K1). Note that, in the middle diagram and the bottom diagram in FIG. 7 and in each diagram in FIG. 8, a virtual paper sheet P0 is described in a part of the gap corresponding to one paper sheet for ease of understanding of the transport state of the preceding medium P1 and the subsequent medium P2.

As shown in the bottom diagram in FIG. 7, recording is performed on the subsequent medium P2, and the preceding medium P1 is sent on the inversion path 16.

When recording on the subsequent medium P2, as shown in the top diagram in FIG. 8, the subsequent medium P2 is sent to the switchback path for both-surface recording 15 and the predetermined wait time is taken. Then, the preceding medium P1 enters again into the straight path 12 from the inversion path 16, and recording is executed on the second surface.

The first transport path 13 is transported on any recording unit path 31 according to whether in the preceding medium P1 on which recording on the second surface ends, the transport destination is the first discharge section 8 (lower left diagram in FIG. 8) or is a transfer section 28 for discharging to the second discharge section 40 (FIG. 1) (lower right diagram in FIG. 8).

The subsequent medium P is sent from the switchback path for both-surface recording 15 on the inversion path 16 and inverted, then enters again into the straight path 12, and recording is executed on the second surface.

Note that, switchback paths (52 and 55) and the pair of correction rollers 62 are provided in the relay unit 3 described above, but either of the switchback paths (52 and 55) and the pair of correction rollers 62 may not be provided. Or neither may be provided.

Note that, the invention is not limited to the application examples described above, and various modifications are possible within the scope of the invention described in the claims which can be said to include the inventions included in the scope of the invention.

The entire disclosure of Japanese Patent Application No. 2017-089835, filed on Apr. 28, 2017 is expressly incorporated by reference herein.

What is claimed is:

1. A recording apparatus comprising:

a recording section that performs recording by ejecting liquid on a medium;

a transfer section that transfers the medium after recording to an adjacent unit that is provided adjacent to the transfer section;

a first discharge section that discharges the medium after recording without transferring to the adjacent unit;

a switching section that switches a transport destination of the medium after recording between the transfer section and the first discharge section;

an inversion path for inverting the medium from a first surface of the medium to a second surface of the medium after recording on the first surface; and a controller that controls an operation related to recording on the medium and transport of the medium, wherein the controller causes the medium on which recording is performed on the first surface by the recording section to wait for a predetermined wait time that is set based on the transport destination of the medium after recording on the second surface, then performs recording on the second surface of the inverted medium via the inversion path, and the predetermined wait time is shorter in a case where the transport destination of the medium after recording on the second surface is the transfer section than in a case where the transport destination of the medium after recording on the second surface is the first discharge section.

2. The recording apparatus according to claim 1, wherein the controller executes the wait time change control in a case where ejecting amount of the liquid from the recording section with respect to the first surface of the medium exceeds a predetermined threshold.

3. The recording apparatus according to claim 1, wherein the recording section is configured to perform recording by ejecting the liquid on the medium, the liquid being water-based ink.

4. The recording apparatus according to claim 1, further comprising:

a switchback path for inverting a transport direction of the medium, wherein the controller causes the medium on which recording is performed on the first surface by the recording section to wait for the predetermined wait time in the switchback path.

5. A recording system comprising:

a recording unit that is provided with a recording section that performs recording by ejecting liquid on a medium;

a post-processing unit that executes post-processing on the medium on which recording is executed in the recording unit; and a relay unit provided adjacent to the recording unit and transporting the medium from the recording unit to the post-processing unit, wherein the recording unit is provided with a transfer section that transfers the medium after recording to the relay unit, a first discharge section that discharges the medium after recording without transferring to the relay unit, a switching section that switches a transport destination of the medium after recording between the transfer section and the first discharge section, and a controller that controls an operation related to recording that includes transport of the medium and operation of the switching section in the recording unit, the controller causes the medium on which recording is performed on the first surface by the recording section to wait for a predetermined wait time that is set based on the transport destination of the medium after recording on the second surface, then performs recording on the second surface of the inverted medium via the inversion path, and the predetermined wait time is shorter in a case where the transport destination of the medium after recording on the second surface is the transfer section than in a case where the transport destination of the medium after recording on the second surface is the first discharge section.

6. The recording system according to claim 5, wherein, as a transport path of the medium after recording, a first transport path that is a path from a downstream side of the recording section up to the first discharge section, and a second transport path that is a path from the downstream side of the recording section passing through the transfer section up to a second discharge section through which the medium on which post-processing is executed in the post-processing unit is discharged, are provided, and wherein the second transport path is formed to be longer than the first transport path.

7. The recording system according to claim 6, wherein in a case where the medium is to be discharged from the first discharge section, the controller does not perform a switchback operation in which a transport direction of the medium is inverted in the first transport path after recording on the second surface before being discharged from the first discharge section, and in a case where the medium is to be discharged from the second discharge section, the controller performs the switchback operation at least once in the second transport path after recording on the second surface before being discharged from the second discharge section.

8. The recording system according to claim 7, wherein the second transport path is configured with a recording unit path that passes through the recording unit, a relay unit path that passes through the relay unit, and a post-processing unit path that passes through the post-processing unit, and the relay unit path includes a switchback path on which the switchback operation is executed.

9. The recording apparatus according to claim 6, wherein whether or not a switchback operation is to be performed after recording on the second surface before being discharged from either of the first discharge section or the second discharge section is determined based on whether the medium is discharged to the first discharge section or discharged to the second discharge section, the switchback operation inverting a transport direction of the medium.

10. The recording apparatus according to claim 5, further comprising:

a switchback path for inverting a transport direction of the medium, wherein the controller causes the medium on which recording is performed on the first surface by the recording section to wait for the predetermined wait time in the switchback path.

11. A recording system comprising:

a recording unit that is provided with a recording section that performs recording by ejecting liquid on a medium;

a post-processing unit that executes post-processing on the medium on which recording is executed in the recording unit; and a relay unit provided adjacent to the recording unit and transporting the medium from the recording unit to the postprocessing unit, wherein the recording unit is provided with a transfer section that transfers the medium after recording to the relay unit, a first discharge section that discharges the medium after recording without transferring to the relay unit, a switching section that switches a transport destination of the medium after recording between the transfer section and the first discharge section, and a controller that controls an operation related to recording that includes transport of the medium and operation of the switching section in the recording unit, wherein the controller causes the medium on which recording is performed on the first surface by the recording section to wait for a predetermined wait time, then performs recording on the second surface of the inverted medium via the inversion path, and the predetermined wait time is shorter in a case where the transport destination of the medium after recording on the second surface is the transfer section than in a case where the transport destination of the medium after recording on the second surface is the first discharge section, wherein, as a transport path of the medium after recording, a first transport path that is a path from a downstream side of the recording section up to the first discharge section, and a second transport path that is a path from the downstream side of the recording section passing through the transfer section up to a second discharge section through which the medium on which post-processing is executed in the post-processing unit is discharged, are provided, wherein the second transport path is formed to be longer than the first transport path, wherein when the medium after recording by the recording section is discharged from the first discharge section, the controller does not perform a switchback operation in which a transport direction of the medium is inverted in the first transport path, and when the medium is discharged from the second discharge section, the controller performs the switchback operation at least once in the second transport path, wherein the second transport path is configured with a recording unit path that passes through the recording unit, a relay unit path that passes through the relay unit, and a post-processing unit path that passes through the post-processing unit, and the relay unit path includes a switchback path on which the switchback operation is executed, wherein the controller executes a posture correction operation in which the medium abuts against a medium transport means in a state of being stopped at the further downstream side than the switchback path of the relay unit path, and until performing the posture correction operation after sending out the medium from the switchback path, the medium is transported at a lower speed than a medium transport speed when the posture correction operation is performed.

12. The recording system according to claim 11, wherein the relay unit path is provided with at least two switchback paths.

13. The recording system according to claim 11, wherein the controller accelerates the transport speed of the medium after the posture correction operation more than the transport speed before the posture correction operation.

14. A recording apparatus comprising:

a recording section that performs recording by ejecting liquid on a medium;

a transfer section that transfers the medium after recording to an adjacent unit that is provided adjacent to the transfer section;

a first discharge section that discharges the medium after recording without transferring to the adjacent unit;

a switching section that switches a transport destination of the medium after recording between the transfer section and the first discharge section; and a controller that controls an operation related to recording on the medium and transport of the medium, wherein the controller causes the medium on which recording is performed on the first surface by the recording section to wait for a predetermined wait time that is set based on the transport destination of the medium after recording, then performs recording on a second surface that is on an opposite side of the first surface, and the predetermined wait time is shorter in a case where the transport destination of the medium after recording is the transfer section than in a case where the transport destination of the medium after recording is the first discharge section.

* * * * *